US010761456B2

(12) United States Patent
Suzuki

(10) Patent No.: US 10,761,456 B2
(45) Date of Patent: Sep. 1, 2020

(54) DEVELOPING DEVICE AND IMAGE FORMING APPARATUS

(71) Applicant: Konica Minolta, Inc., Chiyoda-ku, Tokyo (JP)

(72) Inventor: Mei Suzuki, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/382,510

(22) Filed: Apr. 12, 2019

(65) Prior Publication Data

US 2019/0346792 A1 Nov. 14, 2019

(30) Foreign Application Priority Data

May 10, 2018 (JP) ..... 2018-091470

(51) Int. Cl.
*G03G 15/08* (2006.01)

(52) U.S. Cl.
CPC ..... *G03G 15/0889* (2013.01); *G03G 15/0891* (2013.01)

(58) Field of Classification Search
None
See application file for complete search history.

(56) References Cited

U.S. PATENT DOCUMENTS 4,901,115 A * 2/1990 Nakamura ..... G03G 15/0849 118/689

FOREIGN PATENT DOCUMENTS

JP 2010-210697 9/2010

OTHER PUBLICATIONS

JP_2010210697_A_T Translation, Japan, Yoshida (Year: 2010).*

* cited by examiner

*Primary Examiner* — Victor Verbitsky
(74) *Attorney, Agent, or Firm* — Baker Hostetler

(57) ABSTRACT

Disclosed is a developing device, which may include: a casing that stores developer containing toner; and a screw arranged inside the casing, wherein the screw includes: a rotary shaft; and a screw blade that is spirally arranged around the rotary shaft and conveys the toner from an upstream side to a downstream side by rotation of the rotary shaft, the screw blade includes a discontinuous region, a paddle extending in a radial direction of the rotary shaft is provided along an axial direction of the rotary shaft on a surface of the rotary shaft located in the discontinuous region, and a recess and a protrusion are provided at an edge side in a radial direction of the paddle.

14 Claims, 7 Drawing Sheets

DEVELOPING DEVICE AND IMAGE FORMING APPARATUS

CROSS REFERENCE TO RELATED APPLICATIONS

This application claims priority to Japanese Patent Application No. 2018-091470, filed on May 10, 2018, which is incorporated herein by reference in its entirety.

BACKGROUND

Technological Field

A developing device and an image forming apparatus of the present disclosure relate to a developing device and an image forming apparatus in which an image is formed by electrophotography. The image forming apparatus includes an electrophotographic apparatus such as a digital copying machine, a facsimile machine, or a printer, a recording apparatus, a display device, and the like regardless of color or monochrome.

Description of the Related Art

JP 2010-210697 A relates to a developing device and an image forming apparatus, and discloses a structure of the developing device capable of reducing a difference in bulk density on a detection surface of a toner density detection sensor during stirring operation while preventing erroneous detection caused by accumulation of developer on the detection surface.

According to JP 2010-210697 A, a detection surface stirring member capable of stirring developer while rubbing a detection surface of a toner density detection sensor is provided at a position located in an axial direction of a conveyance screw and facing the detection surface in order to stabilize detection by a toner density detection sensor. This detection surface stirring member is formed in a rectangular waveform and includes, at each protrusion of the waveform, an elastic sheet that is flexible and deformable while contacting the detection surface.

The toner density detection sensor is fixed to the outside of a developing device, and reads toner density of the developer inside the developing device by using a non-contact type toner density detection sensor for the developer. The toner density detection sensor is made by combining a coil and a capacitor, and reads magnetic permeability of a carrier inside the developer. To accurately detect the toner density inside the developing device, an amount of the developer existing at the position of the toner density detection sensor is required to be constant all the time.

However, since force pushed by a screw blade acts on the developer, in a case where a rotation speed of the conveyance screw is accelerated, conveyance force acting on the developer becomes larger. In a case where the screw blade has a continuous shape, the developer existing at the position facing the toner density detection sensor is conveyed as it is, a constant amount of the developer hardly exists, and it is difficult to accurately detect the toner density.

On the other hand, in a case where the amount of the developer is reduced, the amount of the developer at the position of the toner density detection sensor is also reduced, and therefore, a sparse space is increased and a detection error is likely to occur.

SUMMARY

The present disclosure may be directed to: solving one or more of the above-described problems; and providing a developing device and an image forming apparatus both including a structure in which toner density of a developer inside the developing device may be accurately detected.

To achieve the abovementioned object, according to an aspect of the present disclosure, a developing device reflecting one aspect of the present disclosure comprises: a casing that stores developer containing toner; and a screw arranged inside the casing, wherein the screw includes: a rotary shaft; and a screw blade that is spirally arranged around the rotary shaft and conveys the toner from an upstream side to a downstream side by rotation of the rotary shaft, the screw blade includes a discontinuous region, a paddle extending in a radial direction of the rotary shaft is provided along an axial direction of the rotary shaft on a surface of the rotary shaft located in the discontinuous region, and a recess and a protrusion are provided at an edge side in a radial direction of the paddle.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure.

DETAILED DESCRIPTION OF EMBODIMENTS

Figure 1:
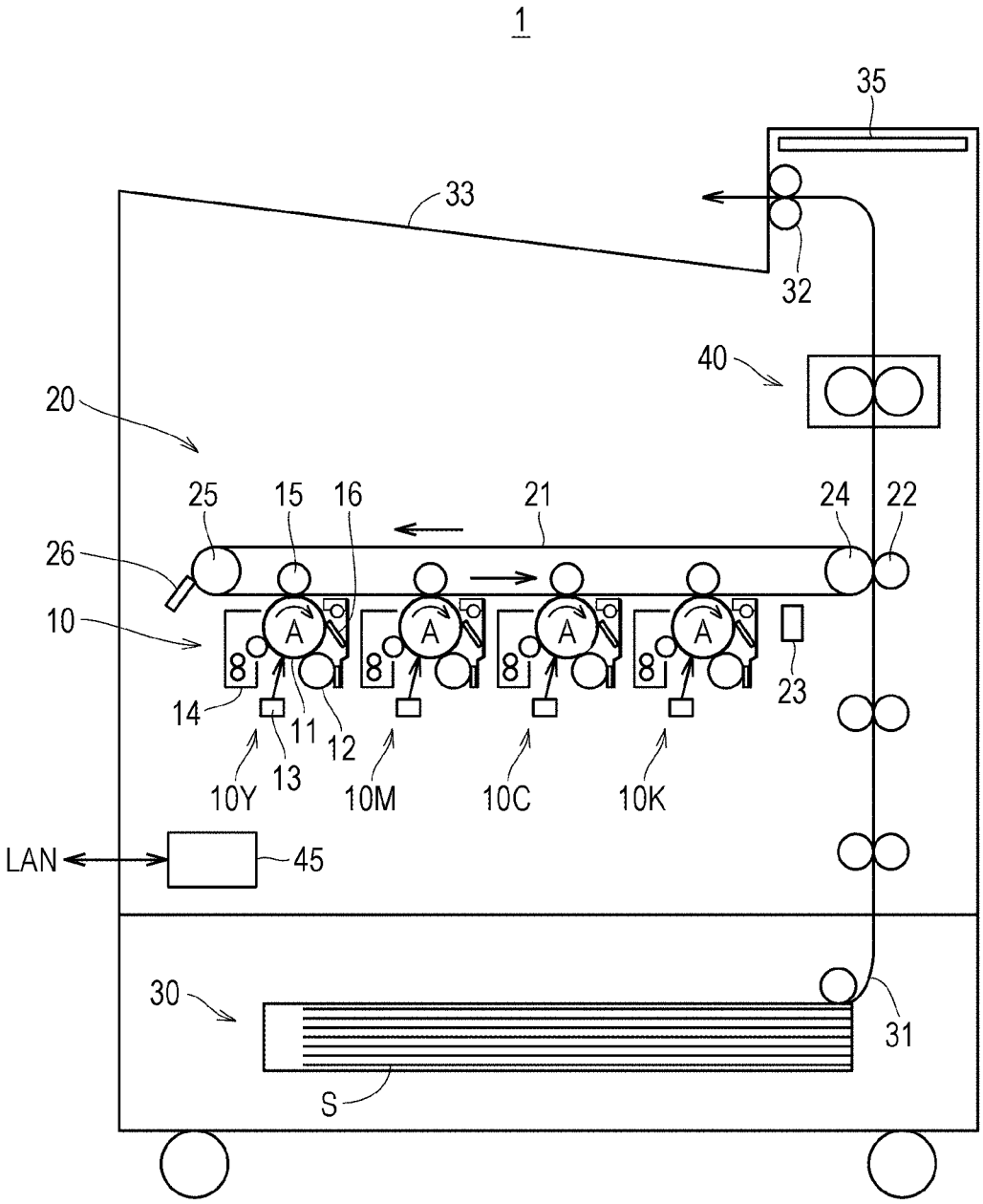
FIG. 1 is a diagram illustrating a schematic structure of an image forming apparatus according to an embodiment.

Hereinafter, one or more embodiments of the present disclosure will be described with reference to the drawings. However, the scope of the disclosure is not limited to the disclosed embodiments. In a case of referring to number, an amount, and the like in each of the embodiments described below, the scope of the present disclosure is not necessarily limited by the number, the amount, and the like, unless otherwise particularly specified. Identical components or equivalent components are denoted by the same reference signs, and there may be a case where the same description is not repeated. In the drawings, there may be a part illustrated in a manner not conforming to a ratio of an actual dimension, and the ratio is changed to clarify a structure for easy understanding The image forming apparatus includes: an MFP having a scanner function, a copying function, a function as a printer, a facsimile function, a data communication function, and a server function; a facsimile machine; or a copying machine.

(Image Forming Apparatus)

In the following, an image forming apparatus 1 according to the present embodiment will be described with reference to FIG. 1. FIG. 1 is a diagram illustrating a schematic structure of the image forming apparatus 1 according to the present embodiment.

The image forming apparatus 1 forms an image on a recording medium by a known electrophotographic system. The image forming apparatus 1 includes an image processor 10, a transfer part 20, a sheet feeder 30, a fixing device 40, and a controller 45. The image forming apparatus 1 selectively executes color and monochrome printing based on a print job received from an external terminal device (not illustrated) via a network (such as a LAN).

The image processor 10 includes image forming units 10Y, 10M, 10C, and 10K corresponding to developing colors of yellow (Y), magenta (M), cyan (C), and black (K). The image forming unit 10Y includes: a photoreceptor drum 11 that is an electrostatic latent image carrier; an electric charger 12; an exposure device 13; a developing device 14; a primary transfer roller 15; a cleaner 16; and the like which are arranged around the photoreceptor drum 11. The electric charger 12 charges a peripheral surface of the photoreceptor drum 11 that is rotated in a direction indicated by an arrow A.

The exposure device 13 exposes and scans the charged photoreceptor drum 11 with laser light to form an electrostatic latent image on the photoreceptor drum 11. The developing device 14 stores developer containing toner inside thereof and develops the electrostatic latent image on the photoreceptor drum 11 with the toner, thereby forming a toner image Y on the photoreceptor drum 11. In other words, the toner image is carried on the electrostatic latent image carrier.

The primary transfer roller 15 transfers, onto the intermediate transfer body 21, the Y color toner image that has been formed on the photoreceptor drum 11 by electrostatic action. In other words, the toner image is primarily transferred to the intermediate transfer body. The cleaner 16 cleans residual toner remaining on the photoreceptor drum 11 after the transfer. Other image forming units 10M, 10C, and 10K also have structures similar to the structure of the image forming unit 10Y, and the reference signs therein are omitted in the drawing. The transfer part 20 includes the intermediate transfer body 21 which is stretched around a drive roller 24 and a driven roller 25 and circulated in a direction indicated by an arrow.

In a case of executing color printing (color mode), an image of toner of a corresponding color is formed on the photoreceptor drum 11 in each of the image forming units 10M, 10C, and 10K, and each of the formed toner images is transferred onto the intermediate transfer body 21. Image forming operation of each of the colors Y to K is executed by deviating timing sequentially from an upstream side to a downstream side such that the toner images of the respective colors are superimposed and transferred onto the same position of the intermediate transfer body 21 that is traveling.

The sheet feeder 30 feeds sheets S that are recording media one by one from a sheet feeding cassette in accordance with the above-described image forming timing, and conveys the fed sheet S to a secondary transfer roller 22 on a conveyance path 31. When the sheet S conveyed to the secondary transfer roller 22 passes between the secondary transfer roller 22 and the intermediate transfer body 21, the respective color toner images that have been formed on the intermediate transfer body 21 are collectively secondarily transferred to the sheet S by electrostatic action of the secondary transfer roller 22. In other words, the toner image is secondarily transferred from the intermediate transfer body to the recording medium.

The sheet S onto which the respective color toner images have been secondarily transferred is conveyed to the fixing device 40 and subjected to heating and pressing in the fixing device 40. Consequently, the toner on the surface is fused and fixed to a surface of the sheet S, and then the sheet S is ejected onto a sheet ejection tray 33 by a sheet ejection roller 32. Thus, an image corresponding to the toner image is formed on the recording medium.

In the above description, operation in the case of executing the color mode has been described, but in a case of executing monochrome printing such as in black (monochrome mode), only the image forming unit 10K for the black color is driven to execute image forming (printing) on a sheet S in the black color through the respective steps including electric charging, exposing, developing, transferring, and fixing for the black color.

The toner and a toner pattern on the intermediate transfer body 21, which has not been transferred to the sheet S, are removed by a cleaning blade 26 arranged at a position facing the driven roller 25 interposing the intermediate transfer body 21. On the downstream side of the image forming unit 10K in a travel direction of the intermediate transfer body 21, for example, a density detection sensor 23 including a reflection photoelectric sensor is arranged to detect density of a toner pattern formed on the intermediate transfer body 21.

For example, the controller 45 controls the respective components based on data of a print job received from the external terminal device via the network to execute smooth printing operation. An operation panel 35 is arranged on a front side and an upper side of an apparatus body of the image forming apparatus 1 and also at a position where a user can easily operate the operation panel. The operation panel 35 includes: buttons to receive various commands from the user; a touch panel type liquid crystal display; and the like, and can notifies the controller 45 of content of the received command.

As the above-describe image forming apparatus, an electrophotographic image forming apparatus such as a copying machine, a printer, a digital printing machine, and a simple printing machine can be exemplified, and either a dry type or a wet type may be applied, but using the dry type image forming apparatus is particularly effective.

(Developing Device 14)

Figure 2:
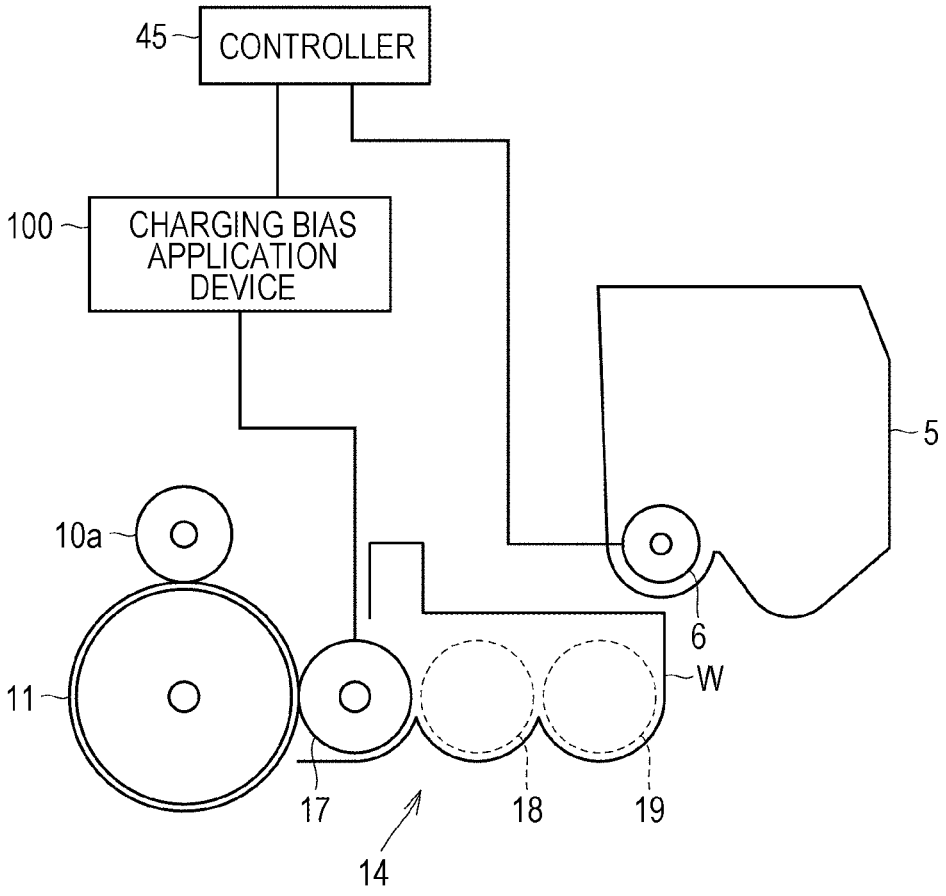
FIG. 2 is a diagram illustrating a schematic structure of a developing device of the embodiment.
Figure 3:
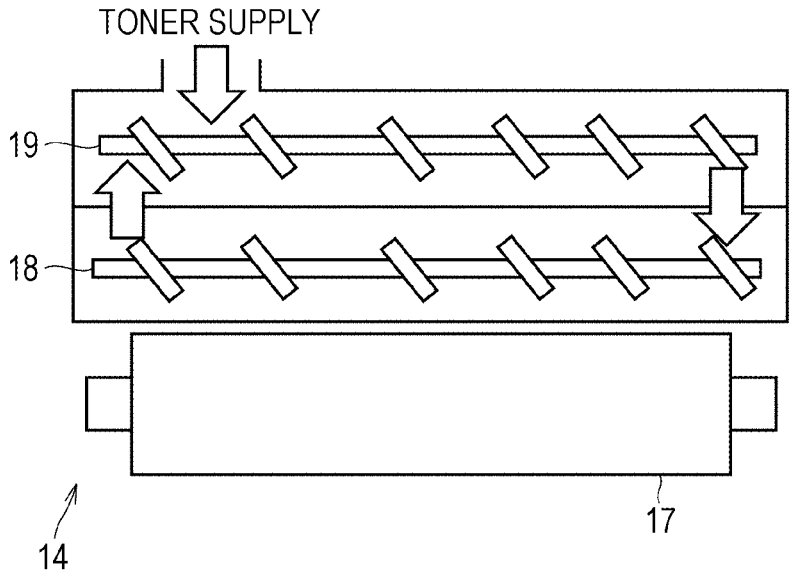
FIG. 3 is a schematic diagram to describe a circulation time in the developing device of the embodiment.

The developing device 14 will be described with reference to FIGS. 2 and 3. FIG. 2 is a diagram illustrating a schematic structure of the developing device 14, and FIG. 3 is a diagram illustrating an arrangement relation between a developing roller 17, a supply screw 18, and a stirring screw 19.

The developing device 14 is provided corresponding to each photoreceptor drum 11, and is arranged in a manner facing a surface of the photoreceptor drum 11. The developing device 14 is applied with charging bias, thereby supplying toner to the photoreceptor drum 11. The developing device 14 makes toner of a predetermined color adhere to an electrostatic latent image formed on the photoreceptor drum 11, and forms a toner image on the surface of the photoreceptor drum 11.

The developing device 14 includes the developing roller 17, the supply screw 18, and the stirring screw 19 which are arranged in a manner facing the surface of the photoreceptor drum 11. The toner cartridge 5 is provided corresponding to each developing device 14, and stores the toner to be supplied to the developing device 14. The developing roller 17, the supply screw 18, and the stirring screw 19 are housed inside the casing (wall surface W).

The toner supply device 6 is provided corresponding to each toner cartridge 5 and each developing device 14, and supplies the developing device 14 with the toner stored in the toner cartridge 5. The toner supply device 6 and the developing device 14 are connected by a toner supply path (not illustrated).

The developing device 14 includes a charging bias application device 100 in addition to the above-described components. The charging bias application device 100 executes a command from the controller 45. The charging bias application device 100 applies predetermined charging bias to the developing device 14. Specifically, the charging bias application device 100 applies the predetermined charging bias to the developing roller 17. The charging bias application device 100 adjusts the charging bias under the control of the controller 45. The charging bias is bias obtained by superimposing AC bias on DC bias.

Referring to FIG. 3, supply toner to be supplied from the toner cartridge 5 is firstly injected into one end side (right side in the drawing) of the stirring screw 19. The injected toner is stirred by the stirring screw 19 with existing developer while being transferred to the other end side (left side in the drawing).

The toner having reached the other end of the stirring screw 19 is moved to one end side of the supply screw 18. The developer having reached the one end side of the supply screw 18 is moved to the other end side of the supply screw 18 while being passed over to the developing roller from the supply screw 18. After that, residual developer is returned to the one end side of the stirring screw 19 again. Thus, the toner injected into the one end side of the stirring screw 19 is circulated through a circulation path in which the stirring screw 19 and the supply screw 18 of the developing device 14 are arranged.

(Specific Structure of Stirring Screw 19)

Figure 4:
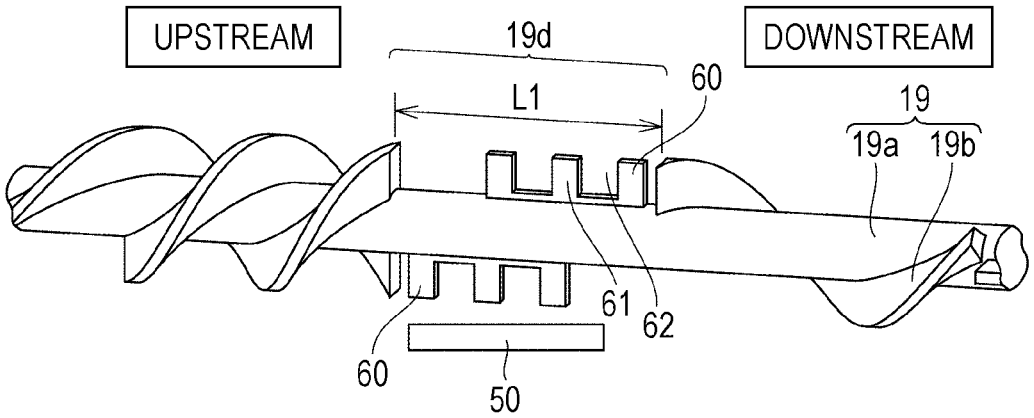
FIG. 4 is a partially enlarged perspective view illustrating a specific structure of a stirring screw of the embodiment.

A specific structure of the stirring screw 19 in the present embodiment will be described with reference to FIG. 4. FIG. 4 is a partially enlarged perspective view illustrating the specific structure of the stirring screw 19.

The stirring screw 19 includes a rotary shaft 19*a* and a screw blade 19*b* spirally provided around the rotary shaft 19*a*.

The screw blade 19*b* at a position facing the toner density detection sensor 50 is provided with a discontinuous region 19*d* not including the screw blade 19*b* and having a length L1. Additionally, a surface of the discontinuous region 19*d* of the rotary shaft 19*a* is provided with two paddles 60 at positions facing each other by 180 degrees, and each of the paddles extends in the radial direction of the rotary shaft 19*a* along an axial direction of the rotary shaft 19*a*. Three protrusions 61 and two recesses 62 are provided on an edge side of each paddle 60, and the paddle 60 has a comb-tooth shape as a whole. The number of the paddles 60 can be appropriately changed.

Furthermore, the paddles 60 facing each other are arranged in a manner such that phases of the recesses 62 are deviated from each other. Specifically, one recess 62 of one paddle is arranged at a position facing one recess of the other paddle position, and the other recess 62 of the one paddle is arranged at a position not facing any recess of the other paddle. In the one paddle 60 (on an upper side in FIG. 4), a large space S is provided in a space with the upstream-side screw blade 19*b*. In the other paddle 60 (on a lower side in FIG. 4), a large space S is provided in a space with the downstream-side screw blade 19*b*.

Thus, in the stirring screw 19 of the present embodiment, the screw blade 19*b* facing the toner density detection sensor 50 is formed discontinuous, and the comb-tooth shaped paddles 60 are arranged in the discontinuous region. The space is provided between the paddle 60 and the upstream-side edge of the screw blade 19*b* (on the upstream side of the discontinuous region), and similarly, the space is also provided between the paddle 60 and the downstream-side edge of the screw blade 19*b* (on the downstream side of the discontinuous region).

With this structure, the developer is accumulated in the discontinuous region 19*d* of the screw blade 19*b* even in a case where operation speed is accelerated and an amount of developer is reduced. A density difference in the accumulated developer is eliminated before and after passage of the paddles 60, and the density of the developer can be kept constant because of the comb-tooth shape of each of the paddles 60.

Furthermore, since the space is also provided between the screw blade 19*b* and each paddle 60, it is possible to more effectively eliminate the density difference in the developer. Even in a case where a conveying speed is accelerated, conveying force is lost between each paddle 60 and the edge of the screw blade 19*b* in the discontinuous region 19*d*, and the developer can be easily accumulated at the position facing the toner density detection sensor 50.

<Discontinuous Region 19*d*/Arrangement Position of Toner Density Detection Sensor 50>

Figure 5:
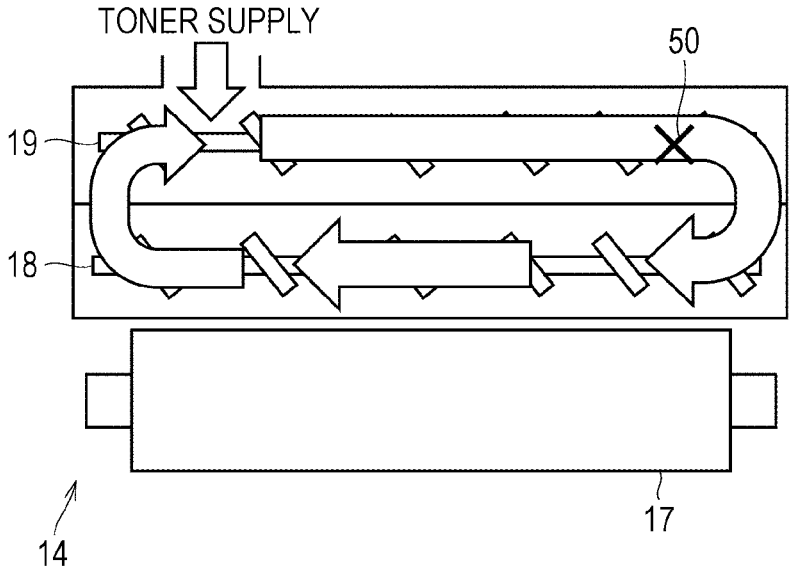
FIG. 5 is a diagram illustrating an arrangement ration between a developing roller, a supply screw, and the stirring screw of the embodiment.
Figure 6:
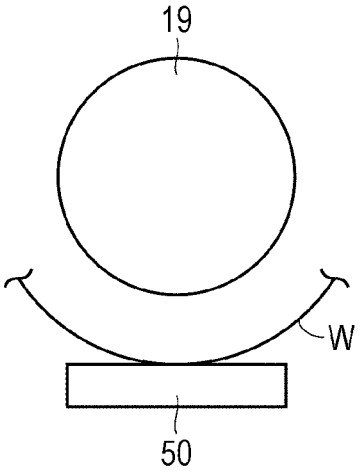
FIG. 6 is a schematic diagram illustrating an arrangement relation between the stirring screw, a wall surface, and a toner density detection sensor of the embodiment.

Preferable arrangement positions of the discontinuous region 19*d* and the toner density detection sensor 50 in the case of adopting the stirring screw 19 having the above-described structure will be described with reference to FIGS. 5 and 6. FIG. 5 is a diagram illustrating an arrangement relation between the developing roller 17, the supply screw 18, and the stirring screw 19, and FIG. 6 is a schematic diagram illustrating an arrangement relation between the stirring screw 19, the wall surface W, and the toner density detection sensor 50. White arrows in FIG. 5 represent moving directions of the toner, and a place marked by "x" represents an arrangement position of the toner density detection sensor 50.

The toner that has been supplied to the stirring screw 19 is stirred by the stirring screw 19 and conveyed to the supply screw 18. The toner that has been conveyed to the supply screw 18 is conveyed to the developing roller 17 together with a carrier.

Referring to FIG. 6, the discontinuous region 19*d* is preferably provided at a position on the downstream side of the stirring screw 19 immediately before conveyance to the supply screw 18 (region where the developer is received), and it is preferable to provide the toner density detection sensor 50 on an outer side of the wall surface W facing a position on the downstream side of the stirring screw 19.

The supplied toner is stirred by the stirring screw 19, and the developer is accumulated in the discontinuous region 19*d* of the screw blade 19*b*. Since the toner density detection sensor 50 is arranged at this facing position, it is possible to stably and highly accurately measure the toner density immediately before conveyance to the supply screw 18. In a case of providing this structure in the supply screw 18, a liquid level height of the developer may be changed, and an image may be defected due to existence of the discontinuous region in the supply screw 18.

<Length (L1) of Discontinuous Region 19*d* and Length of Toner Density Detection Sensor 50>

Figure 7:
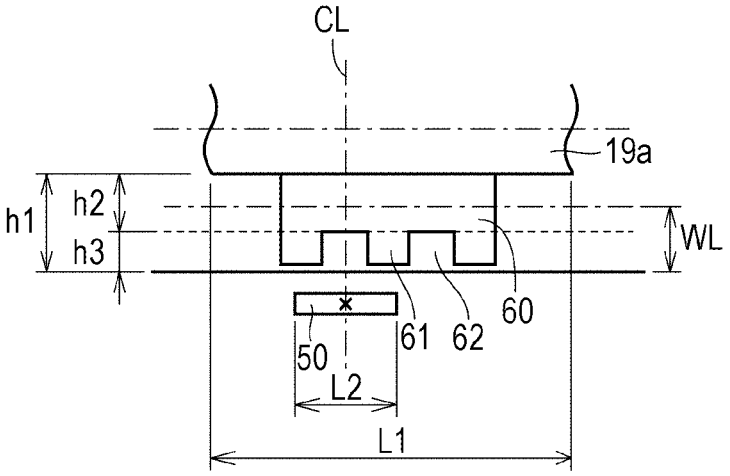
FIG. 7 is a schematic diagram illustrating a relation between a paddle and a liquid level height of developer of toner of the embodiment.

The length (L1) of the discontinuous region 19*d* and a length of the toner density detection sensor 50 will be described with reference to FIG. 7. FIG. 7 is a schematic diagram illustrating a relation between a paddle 60 and a liquid level height (WL) of the developer of the toner.

The region having the constant density of the developer is widened by setting the length (L1) of the discontinuous region 19*d* longer than a length (L2) of the toner density detection sensor 50. Therefore, detection accuracy by the toner density detection sensor 50 can be improved. Here, the length (L2) of the toner density detection sensor 50 represents a length of a sensor coil included in the toner density detection sensor 50.

<Positional Relation>

As for a positional relation between the protrusions 61 of each paddle 60 and the wall surface W, it is preferable that the protrusions 61 of the paddle 60 do not contact an inner side of the wall surface W of the casing. In the case where the protrusions contact the wall surface W, the toner is rubbed against the inner wall surface by the paddle 60, and a phenomenon called spent in which a toner component transitions into a carrier and charging failure is caused occurs.

As illustrated in FIG. 7, as for the positional relation between the paddle 60 and the coil provided inside the toner density detection sensor 50, an arrangement in which a center of the toner density detection sensor 50 (indicated by "x" in FIG. 7) overlaps a center of a recess 62 of the paddle 60 (located on the same line CL) is preferable. Since the developer is accumulated in the recess 62 and the density is kept constant, the detection accuracy can be improved.

<Positional Relation Between Recess 62 of Paddle 60 and Liquid Level Height of Developer>

It is preferable that a bottom portion 62*b* of a recess 62 of each paddle 60 be arranged closer to the wall surface W side inside the casing than a liquid height (WL) of the developer. Here, the liquid level height (WL) of the developer represents a height of the developer from the wall surface W of the casing of the developing device.

Figure 8:
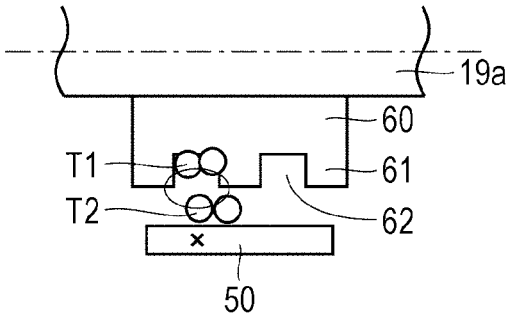
FIG. 8 is a diagram illustrating a stirring state of the developer by the paddle in a discontinuous region of the embodiment.

A stirring state of the developer will be described with reference to FIG. 8. FIG. 8 is a diagram illustrating the stirring state of the developer by one paddle 60 in the discontinuous region 19*d*. As illustrated in FIG. 8, since there are: non-movable developer T2 on a bottom surface; and developer T1 that is movable by being pushed by the recesses 62 of the paddle 60 in the discontinuous region 19*d*, a speed difference is caused in the developer. Since the developer is further stirred due to such a speed difference, supplied toner is conveyed without being superficially slipped, and the toner density can be accurately detected.

(Space (S) Magnitude Relation Between Screw Blade 19*b* and Each of Paddles 60>

Figure 9:
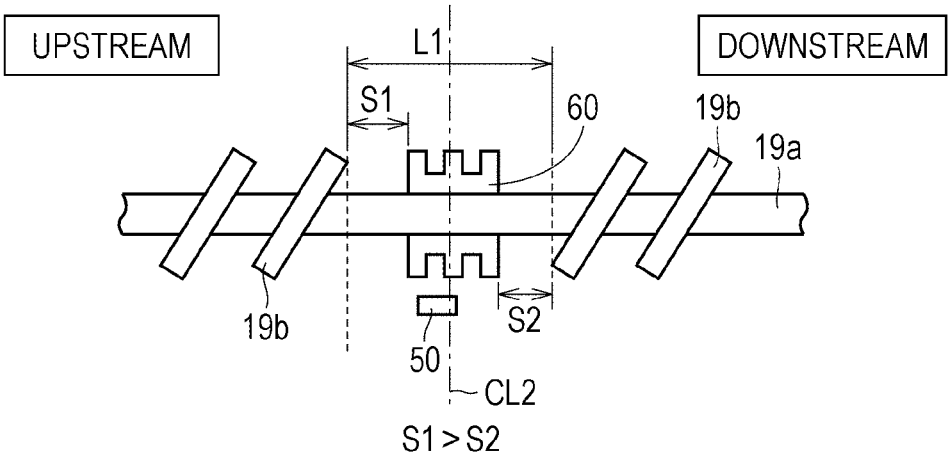
FIG. 9 is a schematic diagram in a case where a space between a screw blade and the paddle of the embodiment is larger on an upstream side.

A space (S) magnitude relation between the screw blade 19*b* and each of the paddles 60 will be described with reference to FIGS. 9 and 10. FIG. 9 is a schematic diagram in a case where a space (S) between the screw blade 19*b* and the paddle 60 is larger on the upstream side, and FIG. 10 is a schematic diagram in a case where a space (S) between a screw blade 19*b* and the paddle 60 is larger on the downstream side.

Referring to FIG. 9, in a case where the toner density detection sensor 50 is arranged more on the upstream side than a center (CL2) of the discontinuous region 19*d*, it is preferable that the space (S1) between the paddle 60 and the upstream-side screw blade 19*b* be set larger than the space (S2) between the paddle 60 and the downstream-side screw blade 19*b* (S1>S2). The larger the accumulated amount of the developer is, the more constant the density of the developer is kept. Therefore, the detection accuracy by the toner density detection sensor 50 can be improved.

Figure 10:
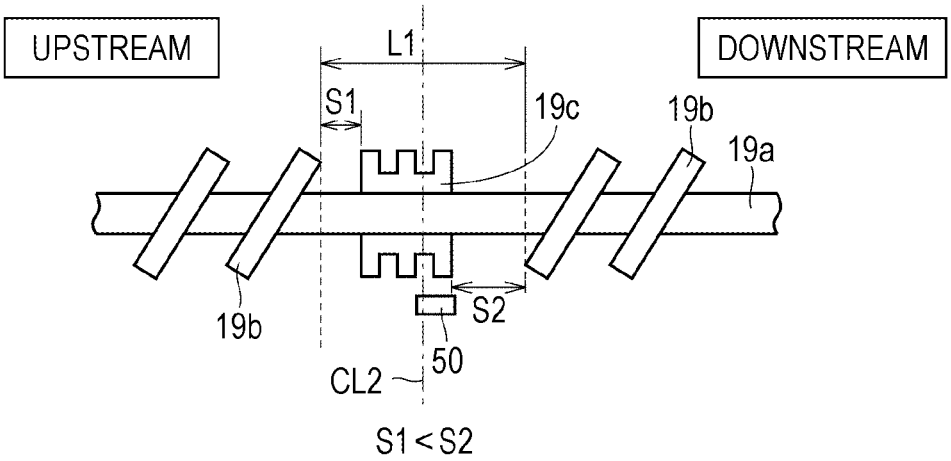
FIG. 10 is a schematic diagram in a case where a space between the screw blade and the paddle of the embodiment is larger on a downstream side.

Referring to FIG. 10, in a case where the toner density detection sensor 50 is arranged more on the downstream side than the center (CL2) of the discontinuous region 19*d*, it is preferable that the space (S2) between the paddle 60 and the downstream-side screw blade 19*b* be set larger than the space (S1) between the paddle 60 and the upstream-side screw blade 19*b* (S1<S2). The larger the accumulated amount of the developer is, the more constant the density of the developer is kept. Therefore, the detection accuracy by the toner density detection sensor 50 can be improved.

(Number of Protrusions 61 Provided in Paddle 60)

Figure 11:
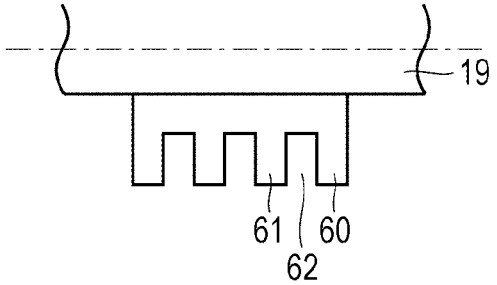
FIG. 11 is a diagram illustrating another form of the paddle of the embodiment.

The number of protrusions 61 provided in one paddle 60 will be described with reference to FIG. 11. FIG. 11 is a diagram illustrating another form of the paddle 60.

The above-described paddle 60 is illustrated to have a structure including the three protrusions 61 and the two recesses 62. The developer is pushed by the protrusions of the paddle 60, the developer is stirred due to a speed difference of the developer caused in the discontinuous region 19*d*. Accordingly, stirring performance for the developer accumulated in the discontinuous region 19*d* is improved by having the plurality of protrusions, and the detection accuracy is improved. Therefore, as illustrated in FIG. 11, a structure including four protrusions 61 and three recesses 62 may also be adopted, or a paddle 60 including the number of protrusions 61 equal to or more than four and the number of recesses 62 equal to or larger than three may also be adopted.

(Number of Paddles 60)

Figure 12:
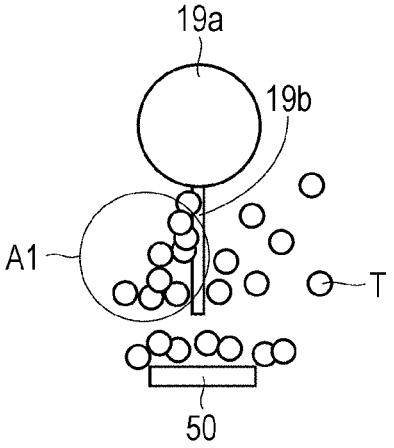
FIG. 12 is a schematic diagram in a case where one paddle is provided in the discontinuous region of the embodiment.
Figure 13:
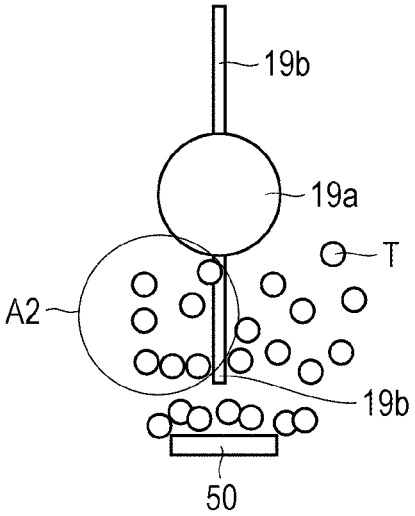
FIG. 13 is a schematic diagram in a case where two paddles are provided in the discontinuous region of the embodiment.

The number of paddles 60 provided in the discontinuous region 19*d* of the stirring screw 19 will be studied with reference to FIGS. 12 and 13. FIG. 12 is a schematic diagram in a case where one paddle 60 is provided in the discontinuous region 19*d*, and FIG. 13 is a schematic diagram in a case where two paddles 60 are provided in the discontinuous region 19*d*.

The stirring screw 19 illustrated in FIG. 4 has the discontinuous region 19*d* in which the two paddles 60 extending in the radial direction of the rotary shaft 19*a* are provided at the positions facing each other by 180 degrees along the axial direction of the rotary shaft 19*a*. Now, referring to FIG. 12, in a case where the one paddle 60 is provided in the discontinuous region 19*d*, a density difference in the developer having passed through the recesses 62 is eliminated between before and after passage of the paddle 60. However, since the developer is dense in a part pushed by the protrusions 61 of the paddle, the density difference remains between before and after passage through the paddle.

By providing the two paddles 60 as illustrated in FIG. 13, the developer existing in the discontinuous region 19*d* is easily stirred, the density difference in the developer is eliminated, and the density of the developer can be made constant. As a result, the detection accuracy of the toner density by the toner density detection sensor 50 can also be improved. Note that, in the present embodiment, the case of providing the two paddles 60 has been described, but a plurality of paddles 60, that is, three or more paddles may also be provided. In such a case, the developer existing in the discontinuous region 19*d* is more easily stirred by arranging the protrusions and the recesses of the respective paddles 60 in a manner such that mutual phases are deviated from each other as described in FIG. 4.

Although embodiments of the present disclosure have been described and illustrated in detail, the disclosed embodiments are made for purposes of illustration and example only and not limitation. The scope of the present disclosure should be interpreted by terms of the appended claims.

As used throughout this application, the words "can" and "may" are used in a permissive sense (i.e., meaning having the potential to), rather than the mandatory sense (i.e., meaning must). The words "include", "including", and "includes" and the like mean including, but not limited to. As used herein, the singular form of "a", "an", and "the" include plural references unless the context clearly dictates otherwise. As employed herein, the term "number" shall mean one or an integer greater than one (i.e., a plurality).

Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device.

What is claimed is:

1. A developing device, comprising:

a casing that stores developer containing toner;

a toner density detection sensor; and a screw arranged inside the casing, wherein the screw includes:

a rotary shaft; and a screw blade that is spirally arranged around the rotary shaft and conveys the toner from an upstream side to a downstream side by rotation of the rotary shaft, wherein the screw blade includes a discontinuous region, wherein a paddle extending in a radial direction of the rotary shaft is provided along an axial direction of the rotary shaft on a surface of the rotary shaft located in the discontinuous region, wherein an amount of space extending in the axial direction between the paddle and the screw blade is based on a location of the toner density detection sensor in the axial direction, and wherein a recess and a protrusion are provided at an edge side in a radial direction of the paddle.

2. The developing device according to claim 1, the screw being provided with the discontinuous region and the paddle, wherein the developing device further comprises:

a supply screw that is arranged in parallel with the screw and that receives the developer conveyed by the screw.

3. The developing device according to claim 2, wherein the discontinuous region and the paddle are provided in a receiving region of the toner provided on the downstream side.

4. The developing device according to claim 1, wherein the paddle is arranged in a manner not contacting an inner wall surface of the casing.

5. The developing device according to claim 1, wherein the space between the paddle and the screw blade is located on the upstream side in a view from the discontinuous region.

6. The developing device according to claim 1, wherein the space between the paddle and the screw blade is located on the downstream side in a view from the discontinuous region.

7. The developing device according to claim 1, wherein the toner density detection sensor detects density of the toner contained in the developer of the casing, wherein the toner density detection sensor includes a sensor coil, and wherein a length of the discontinuous region is longer than a length of the sensor coil.

8. The developing device according to claim 7, wherein, in a case where the toner density detection sensor is arranged closer to the upstream side than a center of the discontinuous region, the amount of space between the paddle and the screw blade is larger at the upstream side than at the downstream side in a view from the discontinuous region.

9. The developing device according to claim 7, wherein, in a case where the toner density detection sensor is arranged closer to the downstream side than a center of the discontinuous region, the amount of space between the paddle and the screw blade is larger at the downstream side than at the upstream side in a view from the discontinuous region.

10. The developing device according to claim 7, wherein a center of the toner density detection sensor and a center of a recess of the paddle are arranged so as to overlap each other.

11. The developing device according to claim 1, wherein a bottom portion of the recess of the paddle is located closer to a side of the casing than to a liquid level height of the developer.

12. The developing device according to claim 1, wherein a plurality of recesses and a plurality of protrusions are provided on an edge side in the radial direction of the paddle.

13. The developing device according to claim 1, wherein a plurality of the paddles is provided on the surface of the rotary shaft located in the discontinuous region.

14. An image forming apparatus, comprising:

a developing device that develops an electrostatic image formed on a photoreceptor drum into a toner image;

a primary transfer part that transfers, to an intermediate transfer body, the toner image formed on the photoreceptor drum; and a secondary transfer part that transfers, to a recording medium, the toner image that has been transferred to the intermediate transfer body, wherein the developing device is the developing device according to claim 1.

* * * * *